US005487379A

United States Patent [19]

Koshiishi

[11] Patent Number: 5,487,379

[45] Date of Patent: Jan. 30, 1996

[54] SNORKEL

[75] Inventor: Eiichi Koshiishi, Tokyo, Japan

[73] Assignee: Harisan Co., Ltd., Tokyo, Japan

[21] Appl. No.: 332,765

[22] Filed: Nov. 1, 1994

[30] Foreign Application Priority Data

Aug. 30, 1994 [JP] Japan ..... 6-204910

[51] Int. Cl.[6] ..... A62B 7/00; B63C 11/00

[52] U.S. Cl. ..... 128/201.11; 128/201.27; 128/201.28

[58] Field of Search ..... 128/201.11, 201.26, 128/201.27, 201.28, 205.24, 207.14, 207.16, 911

[56] References Cited

U.S. PATENT DOCUMENTS 4,304,229 12/1981 Curtin ..... 128/205.24
4,739,987 4/1988 Nicholson ..... 128/207.16
4,805,610 2/1989 Hunt ..... 128/201.27
4,838,262 6/1989 Katz ..... 128/205.24
5,261,396 11/1993 Faulconer et al. ..... 128/201.11
5,267,556 12/1993 Feny ..... 128/207.14

*Primary Examiner*—Edgar S. Burr
*Assistant Examiner*—V. Srivastava
*Attorney, Agent, or Firm*—Nikaido, Marmelstein, Murray & Oram

[57] ABSTRACT

Disclosed is an improved snorkel using an adjustable valve mechanism having a rotatable restrictive plate to control the bottom opening area of the tubular body. The snorkel can be adjusted in terms of individual lung capacities so that the expiratory pressure may be applied to the water remaining in the tubular body so as to cause the simultaneous exhaust of the remaining water from the top and bottom ends of the tubular body.

2 Claims, 5 Drawing Sheets

SNORKEL

BACKGROUND OF THE INVENTION

1. Field of the Invention

The present invention relates to an improvement in or relating to a snorkel, more particularly to an improved snorkel which permits the adjusting of the exhaust amount from its valve to meet individual lung capacities, thereby permitting the simultaneous exhaust of the remaining water from the upper and lower ends of the tubular body of the snorkel.

2. Description of Related Art

One example of a conventional snorkel is disclosed in Japanese Utility Model (Hei) 6-10098(A). As shown in FIG. 9, it includes a valve mechanism 3 comprising a valve body (exhaust valve seat) 30 fixed to the water-exhaust bottom opening 1*b* of the snorkel tubular body 1, an associated flexible, pressure-sensitive element or water-exhaust valve 33 which is permitted to be deformed in cooperation with the valve body 30 for closing or opening, and a valve closure 6 positioned apart from the pressure-sensitive element 33. The water-exhaust valve 33 has a center post 7 defining two semi-openings 8 and 9 in the water-exhaust bottom opening, and the valve closure 6 has two apertures 6*a* and 6*b* facing the two semi-openings 8 and 9.

The valve closure 6 has the effect of preventing sand and other foreign substance from entering into the tubular body of the snorkel 1. The sub-opening areas 8 and 9 cannot be controlled so as to meet individual blowing strengths or individual lung capacities. If the blowing strength is weak, water will be exhausted slowly, and then the water-exhaust valve 33 will be deformed against external water pressure Q to blow remaining water off from the semi-openings 8 and 9, allowing leakage of air from the bottom end of the tubular body. Accordingly the air pressure available for exhausting water from the top opening or air-inlet of the tubular body is reduced, thereby making it difficult to exhaust water from the top opening or air-inlet of the tubular body.

Conversely, if the blowing strength is strong, water will be exhausted from the top opening or air-inlet of the tubular body, but water is allowed to remain on the lower end, and water drops fall from the inside wall of the tubular body on the bottom-remaining water until the water level rises above the permissible limit, sometimes upto the mouth piece.

Ideally the water which remains in the tubular body 1, the mouth piece 2 and the water-exhaust valve mechanism 3 is blown off from the top opening or air-inlet "A" of the tubular body, and at the same time, is exhausted from the bottom opening "B" by lowering the pressure-sensitive element 33, as seen from FIG. 8. The ideal condition in which water and air is exhausted from the top and bottom openings "A" and "B" simultaneously cannot be provided unless the snorkel meets a person's lung capacity.

As the top opening or air-inlet of the tubular body is exposed to the surrounding air, the pressure and impedance against which water and air are exhausted from the top opening or air-inlet of the tubular body is of a small value. The bottom opening of the tubular body is immersed in the water, and the pressure and impedance against which water and air are exhausted from the bottom opening is of a large value because of the adverse effects caused by the viscosity of surrounding water and by the water pressure or water depth from the surface of the sea to the bottom B of the tubular body. For good snorkels $V1 \times L1 = V2 \times L2$, where V1 stands for water-displacement pressure on the top side A of the snorkel, L1 stands for water-exhaust distance to the top end of the snorkel, V2 stands for water-displacement pressure on the bottom side B of the snorkel, L2 stands for water-exhaust distance to the bottom end B of the snorkel; and for bad snorkels $V1 \times L1 < V2 \times L2$ or $V1 \times L1 > V2 \times L2$.

There has been an increasing demand for snorkels which can be adjusted to individual lung capacities or blowing strengths so as to permit the simultaneous water-exhausts from the top and bottom openings of the snorkel.

SUMMARY OF THE INVENTION

One object of the present invention is to provide a snorkel whose water-and-air exhaust can be adjusted to meet individual demands.

To attain this object a snorkel comprising a tubular body having a mouth piece close to its lower end and a water-exhaust valve mechanism fixed to its water-exhaust bottom opening, said mouth piece communicating with said water-exhaust valve mechanism, is improved according to the present invention in that said water-exhaust valve mechanism has means to adjust the opening area of the water-exhaust bottom opening.

The water-exhaust valve mechanism may comprise a valve body attached to the water-exhaust bottom opening of said tubular body in a water-tight fashion, and having a predetermined shape of water-exhaust aperture, and control means movably attached to said valve body for varying the opening area of the water-exhaust bottom opening of said tubular body.

The control means may comprise at least a dial member rotatably attached to said valve body and a restrictive plate responsive to rotation of said dial member for opening or closing the water-exhaust bottom opening of said tubular body, that is, the water-exhaust aperture of said valve body.

Other objects and advantages of the present invention will be understood from snorkels according to preferred embodiments of the present invention, which are shown in accompanying drawings.

DESCRIPTION OF THE PREFERRED EMBODIMENTS

Figure 1:
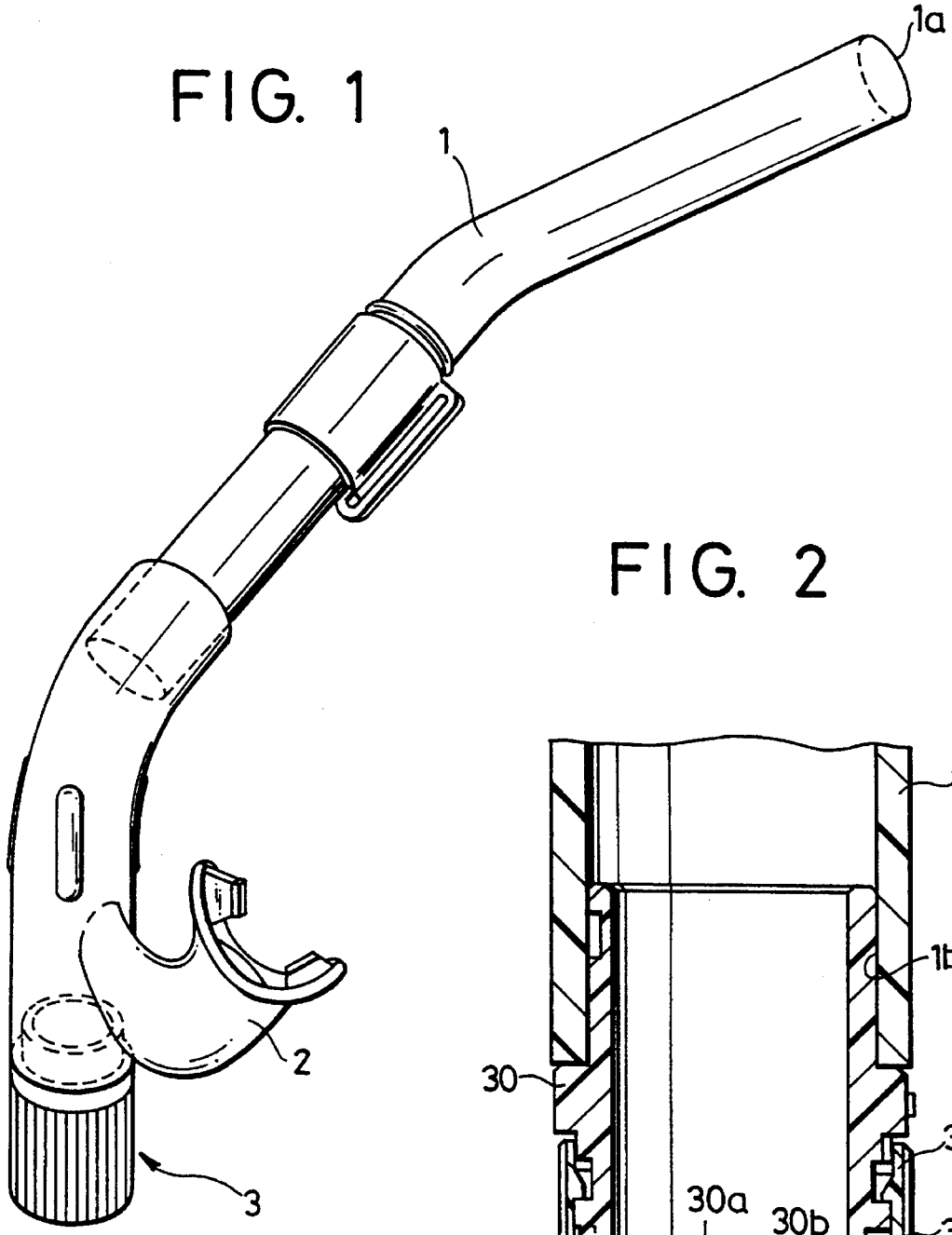
FIG. 1 is a perspective view of a snorkel according to a first embodiment of the present invention.

Referring to FIG. 1, a snorkel according to the first embodiment comprises a tubular body 1 having a mouth piece 2 close to its lower end and a water-exhaust valve mechanism 3 fixed to its water-exhaust bottom opening. The mouth piece 2 communicates with the water-exhaust valve mechanism 3.

The snorkel body 1 is an elongated tubular body made of a synthetic resin such as vinyl chloride or polypropylene. It has an air inlet 1*a* its top end and an exhaust outlet 1*b* at its bottom end as seen from FIG. 2. The tubular body has a diameter ranging from 20 to 23 mm for strong expiration from men, and from 17 to 20 mm For weak expiration from women or children.

The mouth piece 2 is positioned close to the bottom end of the tubular body 1, 3 to 4 cm apart from the bottom end of the tubular body 1, providing a water sump in it.

Figure 2:
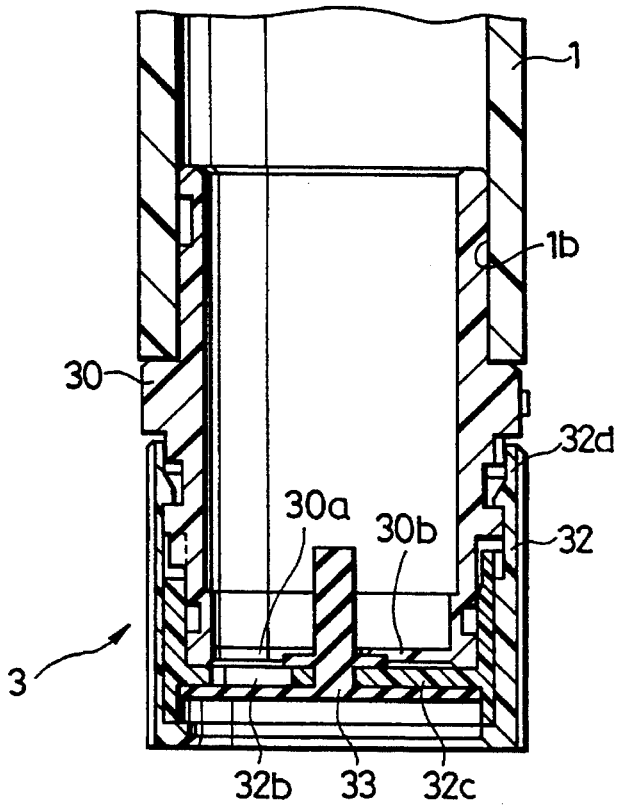
FIG. 2 is an enlarged longitudinal section of the water-exhaust valve mechanism.

As shown in FIG. 2, the water-exhaust valve mechanism 3 comprises an apertured valve body 30 hermetically fitted in the air-exhaust opening 1*b* of the tubular body 1, a water-exhaust valve 33 For closing or opening the aperture 30*a* of the valve body 30, a valve retainer 32 rotatably fixed to the end of the valve body 30, and a dial member 31 rotatably hermetically fixed to the outer circumference of the valve body 30. Rotation of the dial member 31 causes the valve retainer 32 to rotate, thereby varying the opening area of the aperture 30*a* of the valve body 30.

Figure 3:
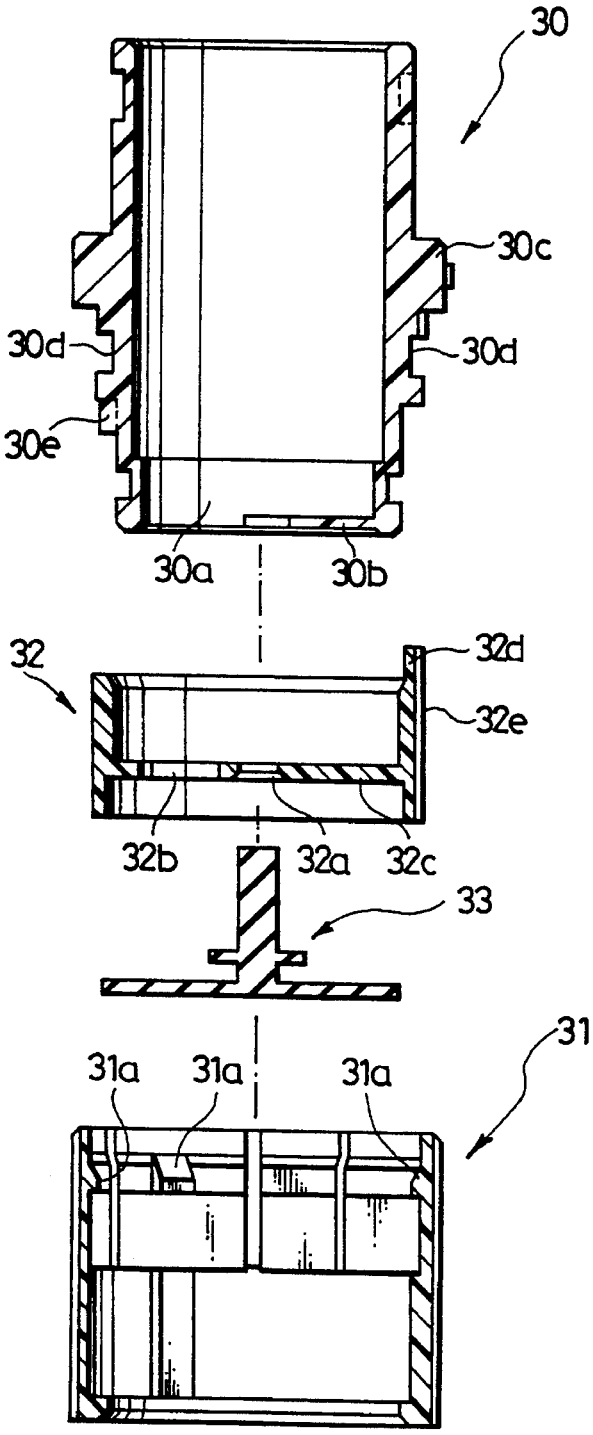
FIG. 3 is an exploded view of the water-exhaust valve mechanism.
Figure 4A:
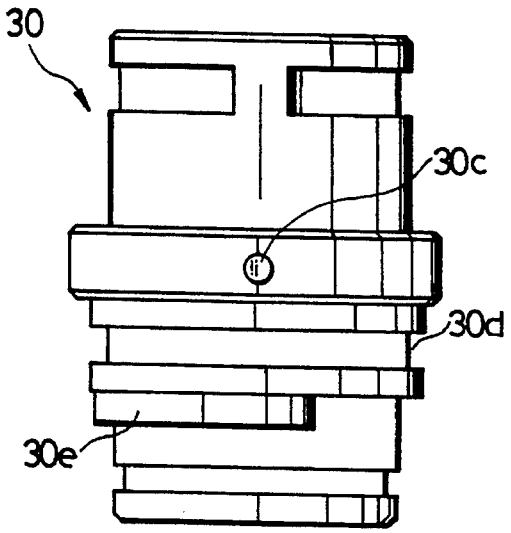
FIGS. 4*a*, 4*b* and 4*c* are front, longitudinally sectional and plane views of the valve body of the water-exhaust valve mechanism respectively.
Figure 4B:
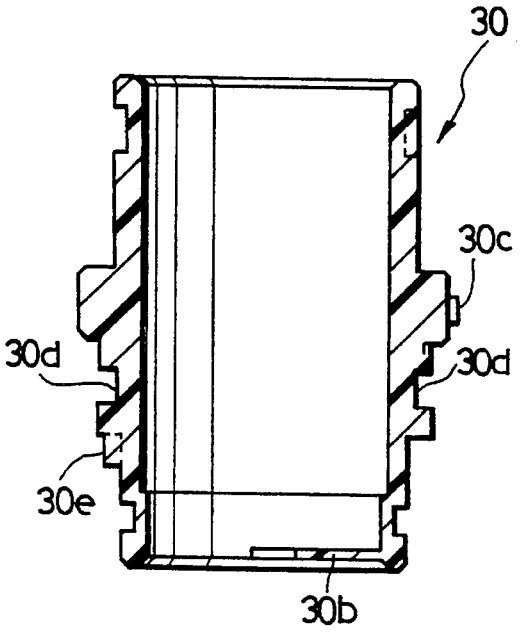
Figure 4C:
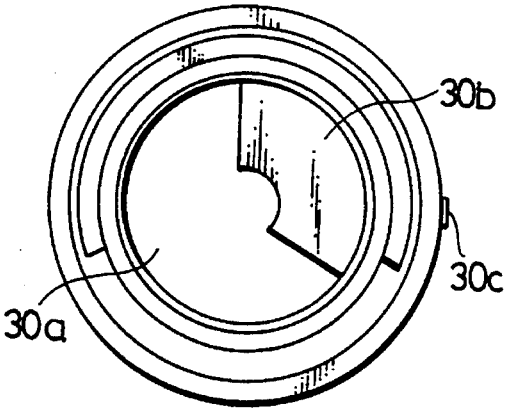

The valve body 30 is a hollow cylinder having a bottom, and its made of a synthetic resin such as polycarbonate or ABS. It has a water-exhaust aperture 30*a* on its bottom as seen from FIGS. 3 and 4. The sector or fan-like aperture 30*a* of the valve body 30 extends two thirds of the bottom area of the valve body 30. The valve retainer 32 has an apertured restrictive plate 32*c* integrally connected thereto, which restrictive plate 32*c* has a similar sector or fan-like aperture. The restrictive plate 32*c* is laid under the apertured bottom plate of the valve body 30, and the underlying restrictive plate 32*c* is rotated by the dial member 31 to adjust the opening area of the fan-like aperture of the bottom plate 30*b* of the valve body 30, thereby adjusting the exhaust amount of the valve.

The valve body 30 has a pointer 30*c* on its outer circumference, thus indicating the reference position of the dial member 31. Also, the valve body 30 has an annular groove 30*d* made just below the pointer 30*c* to permit the dial member 31 to be rotatably fitted in the annular groove 30*d*.

Figure 5A:
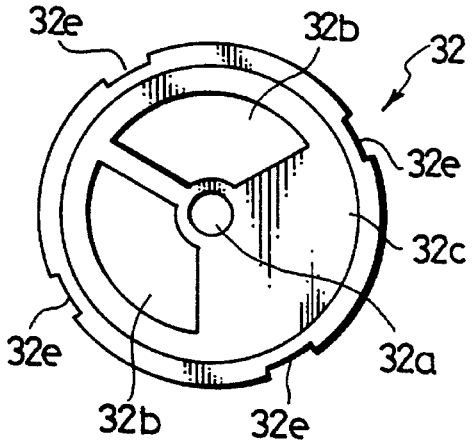
FIGS. 5*a* and 5*b* are bottom and longitudinally sectional views of the valve retainer of the water-exhaust valve mechanism respectively.
Figure 5B:
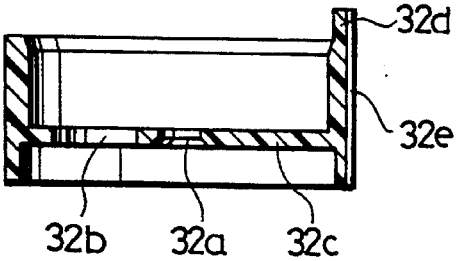

As shown in FIG. 5, the valve retainer 32 is a short cylinder mold of a synthetic resin such as polycarbonate or ABS, and it has a restrictive disk 32*c* integrally connected thereto. The restrictive disk 32*c* has a center aperture 32*a* for attaching a flexible, water-exhaust valve 33 (FIG. 3) of rubber or a flexible synthetic resin, two sector or fan-like apertures 32*b*, 32*b* made symmetrically with respect to the center aperture 32*a*, and the remaining non-apertured area.

The valve retainer 32 has a projection 32*d* rising from its top circumference. When the dial member 31 is rotated in one of the clockwise or counter-clockwise directions, the projection 32*d* of the valve retainer 32 abuts on a counter projection 30*e* (FIG. 4) rising from a selected position of the outer circumference of the valve body 30, thereby preventing further rotation of the valve retainer 32 in the one direction, thus determining the maximum or minimum opening position in the valve body 3, specifically the maximum or minimum opening area of the water-exhaust aperture 30*a*.

As shown in FIG. 5*a*, the valve retainer 32 has four longitudinal recesses 32*e* made in its outer circumference, whereas the dial member 31 has four longitudinal projections 31*a* projecting from its inner wall. The valve retainer 32 is integrally combined with the dial member 31 by engaging these projections 31*a* of the dial member 31 with the counter recesses 32*e* of the valve retainer 32, providing an integral rotatable unit.

The dial member 31 is made of a synthetic resin such as polyacetal or polypropylene, and is rotatably attached to the bottom end of the valve body 30, covering hermetically the valve retainer 32.

Specifically the dial member 31 is press-fitted on the valve retainer 32 with the four longitudinal projections 31*a* of the dial member 31 aligned with the counter longitudinal recesses 32*e* of the valve retainer 32, thus providing an integral rotatable whole, guaranteed free of slipping-off from each other.

The dial member 31 has a pointer 31*b* to indicate the angular distance of dial rotation (FIG. 6) relative to the pointer 30*c* of the valve body 30, thereby indicating the opening area of the water-exhaust aperture 30*a*.

Figure 6A:
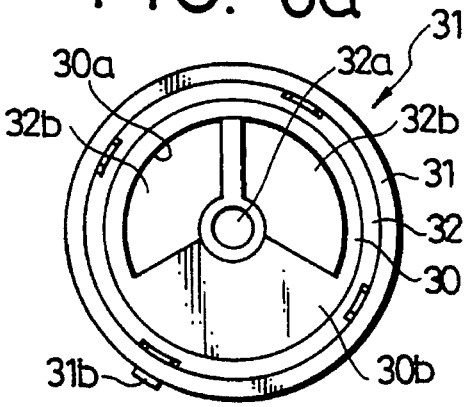
FIGS. 6*a*, 6*b* and 6*c* show how the water-exhaust opening of the valve body varies in response to rotation of the dial member.
Figure 6B:
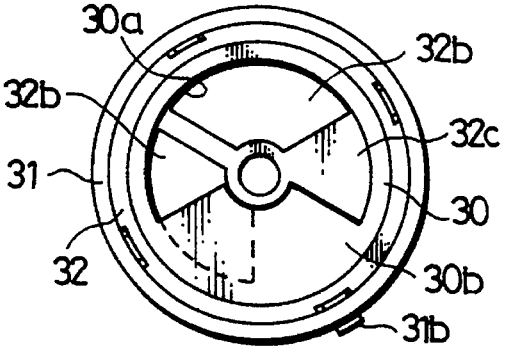
Figure 6C:
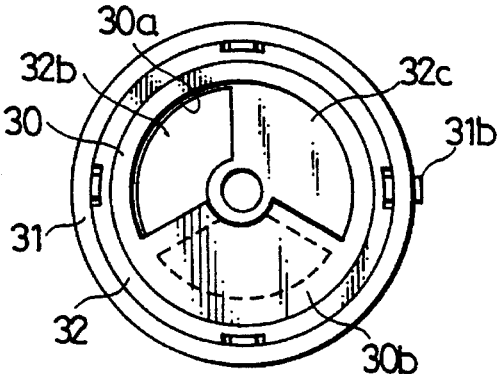

As shown in FIG. 6*a*, the maximum opening is provided when the fan-like aperture 30*a* of the valve body 3 is put in alignment with the fan-like apertures 32*b* and 32*b* of the valve retainer 32. As shown in FIG. 6*b*, the counter-clockwise rotation of the dial member 31 causes the apertured restrictive disk 32*c* to appear in the fan-like aperture 30*a* of the valve body 3, thus closing one third of the fan-like aperture 30*a*. Further counter-clockwise rotation of the dial member 31 causes the apertured restrictive disk 32*c* to close one half of the fan-like aperture 30*a*, as shown in FIG. 6*c*. This is the minimum opening of the water-exhaust aperture 30*a*.

The snorkel can be adjusted simply by rotating the dial member in either direction, thereby meeting individual lung capacities so as to permit the simultaneous water exhaust from the top and bottom ends of the tubular body.

The water-exhaust valve mechanism 3 may be preferably so attached to the end of the tubular body that the opening 30*a* of the valve body and the opening 32*b* of the valve retainer may be situated opposite to or apart from the mouth piece 2, and then these opening 30*a*, 32*b* will be put in a level which is lower than the position of the mouth piece 2 when a diver holds it in mouth, causing the tubular body to be inclined relative to his mouth. This is advantageous to water exhaust from the tubular body.

Figure 7A:
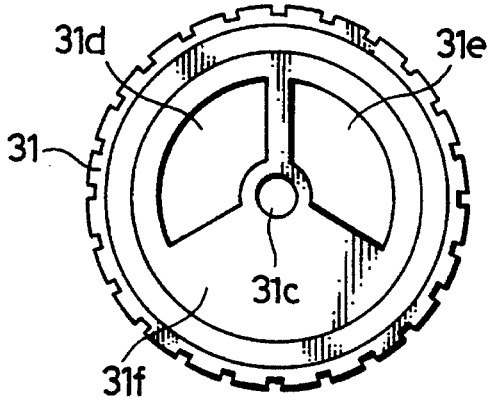
FIGS. 7*a* and 7*b* are bottom and longitudinally sectional views of the dial member of a snorkel according to a second embodiment of the present invention.
Figure 7B:
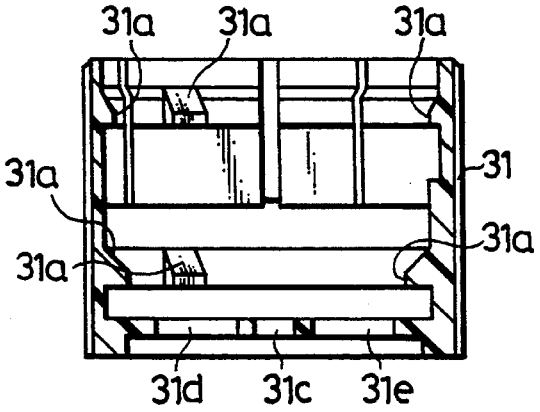
Figure 9:
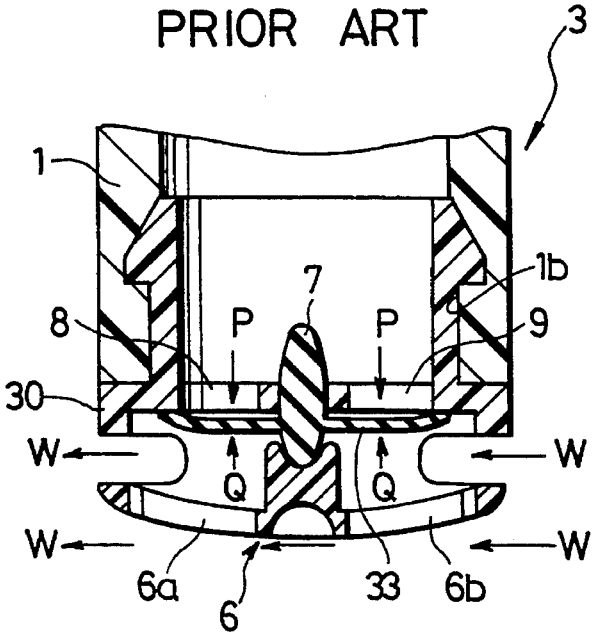
FIG. 9 PRIOR ART
FIG. 9 is an enlarged longitudinal section of the water-exhaust valve mechanism of a conventional snorkel.
Figure 8A:
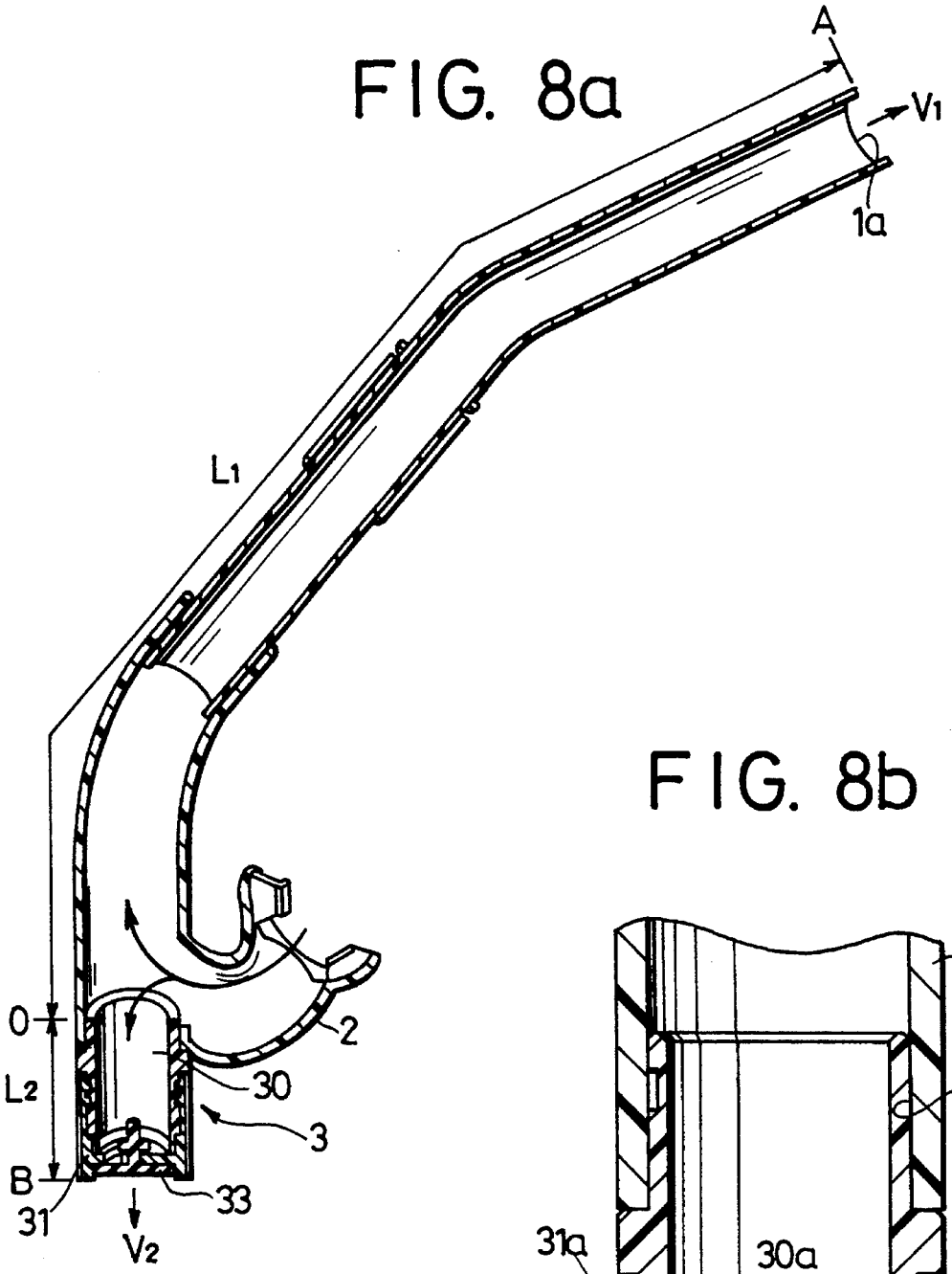
FIG. 8*a* is a longitudinal section of a snorkel according to a second embodiment or the present invention.

Referring to FIGS. 7 and 8, a snorkel according to the second embodiment uses no valve retainer. As seen from FIG. 7*a*, a dial member 31 has a center hole 31*c* for attaching a flexible water-exhaust valve 33 (FIG. 3), and two fan-like openings 31*d*, 31*e*, making use of the remaining area as the restrictive plate 31*f*.

Figure 8B:
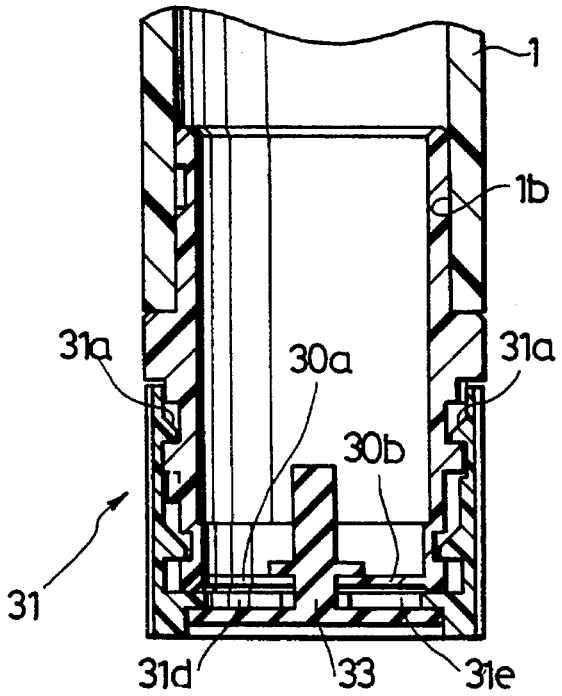
FIG. 8*b* is an enlarged longitudinal section of the water-exhaust valve mechanism.

As seen from FIG. 8*b*, a snorkel may be provided simply by attaching the dial member 31 to the valve body 30. The snorkel uses less number of parts than the first embodiment. The number of parts, and hence assembling steps is reduced, and accordingly the manufacturing cost is reduced.

As in the first embodiment, the projections 31*a* formed on the inner circumference of the dial member 31 are rotatably fitted in the annular groove 30*d* of the valve body 30, preventing the slipping-off of the dial member 31 from the valve body 30.

As in the first embodiment, the maximum opening is provided when the fan-like aperture 30*a* of the valve body 3 is put in alignment with the fan-like apertures 31*d* and 31*e* of the dial member 31. Rotation of the dial member 31 causes the nonapertured area 31*f* to appear in the fan-like aperture 30*a* of the valve body 3, thus gradually closing the fan-like aperture 30*a* until one half of the fan-like aperture is closed. This is the minimum opening of the water-exhaust aperture 30*a*.

With this arrangement the snorkel can be adjusted to meet individual lung capacities simply by rotating the dial member 31 so that the water remaining in the tubular body may be exhausted simultaneously from its top and bottom ends.

As may be understood from the above, a snorkel according to the present invention permits its water-exhaust valve mechanism to be adjusted in terms of individual lung capacities so that the expiratory pressure may be applied to the water remaining in the tubular body so as to cause the simultaneous exhaust of the remaining water from the top and bottom ends of the tubular body. As for the conventional, non-adjustable snorkel in case of insufficient blowing strength water is allowed to be blown off from the bottom of the tubular body, and then the air is allowed to be blown off, leaving little amount of air in the tubular body so that the exhaust of still remaining water from the top of the tubular body is difficult. Conversely in case that the expiratory pressure is too strong, water is liable to remain on the bottom side of the tubular body, and then water in the form of drops falls from the inside wall of the tubular body to be added to the remaining water on the bottom of the tubular body, thus causing total amount of water to reach the mouth piece. The snorkel according to the present invention is free of such problems.

The required adjustment can be attained simply by rotating the dial member until the simultaneous water exhaust from both ends of the tubular body is confirmed by sight.

I claim:

1. A snorkel comprising a tubular body (1) having a mouth piece (2) close to its lower end and a water-exhaust valve mechanism (3) fixed to its water-exhaust bottom opening (1*b*), said mouth piece communicating with said water-exhaust valve mechanism, characterized in that said water-exhaust valve mechanism (3) has a valve body (30) attached to the water-exhaust bottom opening (1*b*) of said tubular body (1) in a water-tight fashion, and having a predetermined shape of water-exhaust aperture (30*a*), and control means movably attached to said valve body (30) for nonstep varying of the opening area of the water-exhaust bottom opening of said tubular body.

2. A snorkel according to claim 1, wherein said control means comprises at least a dial member (31) rotatably attached to said valve body (30) and a restrictive plate (32*c*) responsive to rotation of said dial member for opening or closing the water-exhaust bottom opening of said tubular body or the water-exhaust aperture (30*a*) of said valve body.

* * * * *